US005544680A

United States Patent [19]

De Ro

[11] Patent Number: 5,544,680

[45] Date of Patent: Aug. 13, 1996

[54] WEFT THREAD BRAKE WITH ROTARY DRIVE

[75] Inventor: Ignace De Ro, Ypres, Belgium

[73] Assignee: Picanol N.V., Ypres, Belgium

[21] Appl. No.: 361,193

[22] Filed: Dec. 21, 1994

[30] Foreign Application Priority Data

Dec. 22, 1993 [BE] Belgium ..... BE9301434

[51] Int. Cl.[6] ..... D03D 47/34

[52] U.S. Cl. ..... 139/450; 139/194

[58] Field of Search ..... 242/419.6, 419.7, 242/415.1, 413.8, 153, 154, 156.2; 139/450, 194

[56] References Cited

U.S. PATENT DOCUMENTS

| | | | |
|---|---|---|---|
| 4,494,579 | 1/1985 | Grandvallet et al. | 139/450 |
| 4,854,513 | 8/1989 | Boller et al. | 242/18 R |
| 4,962,796 | 10/1990 | Grimm et al. | 139/194 |
| 5,159,822 | 11/1992 | Schmidt et al. | 139/450 X |
| 5,179,980 | 1/1993 | Hubner et al. | 139/194 X |
| 5,305,966 | 4/1994 | Motta | 139/450 |

FOREIGN PATENT DOCUMENTS

| | | | |
|---|---|---|---|
| 268550 | 5/1988 | European Pat. Off. | 139/194 |
| 0356380 | 2/1990 | European Pat. Off. . | |
| 0527510 | 2/1993 | European Pat. Off. . | |
| 3803146 | 4/1989 | Germany | 139/450 |
| 1664914 | 7/1991 | U.S.S.R. | 139/450 |

*Primary Examiner*—Andy Falik
*Attorney, Agent, or Firm*—Bacon & Thomas

[57] ABSTRACT

A weft brake for an airjet loom includes a controlled drive for causing at least one thread guide to deflect the weft and thereby brake it, and a transmission which permits relative motion between the drive and the thread guide. The transmission is placed between the controlled drive and the thread guide to permit relative motion between the drive and the thread guide. As a result, rapid drive motion will not directly cause a rapid thread guide motion, resulting in a reduction in tension spikes during braking. Because the motion of the thread guide depends on the weft tension, when the weft tension is high, the amount of the deflection and consequent braking is less and the increase in weft tension caused by the braking is in turn limited. Moreover, even in the event of slackening of the weft tension, the weft still is kept tension. The drive may be in the form of a rotary drive and the transmission may be in the form of a helical spring.

9 Claims, 6 Drawing Sheets

20
25
21
39
23

XI
22
20
25
26
21
XI
38
32
38
37
23

36
35
20
25
26
21
22
24
27
26
23

38
32
38
23
20
37
25
21

24
23
25
32
28

8
19
41
47
46
43
23
42
B
45
44

WEFT THREAD BRAKE WITH ROTARY DRIVE

BACKGROUND OF THE INVENTION

1. Field of the Invention

The invention concerns a thread brake for a weaving loom, and in particular a thread brake mounted between a weft thread storing means and a weft insertion means, the thread brake including at least one driven, adjustable thread guide which deflects the weft thread in order to brake it.

2. Description of-Related Art

Thread brakes are used in airjet looms to decelerate a weft near the end of its insertion. As a rule they are mounted between a accumulator and a main jet nozzle affixed to the reed batten. In a known weft brake, disclosed in European patent document A 0,527,510, use is made of stationary and movable thread guides. The movable guides are mounted on a support moved by a controlled, electrical drive. Illustratively, the controlled electrical drive is a motor actuated by a control unit at a given time during weft insertion. The angle of deflection of the thread caused by movement of the movable guides determines the extent of braking.

In looms, and especially in airjet looms, weft insertion lasts only a few milliseconds, and consequently such thread brakes must be operated very quickly. The resulting abrupt deceleration of a weft which has been inserted at high speed has the disadvantage of causing a tension spike to arise in the weft, which may result in a rupture, and which also negatively affects the performance of the thread brake itself.

Another thread brake is known from European patent document A 0,356,380. In this thread brake, the thread deflection is achieved by several braking guides, but the performance of the thread brake is still affected by tension spikes, which have the affect of partly reversing the deflection provided by the guides.

SUMMARY OF THE INVENTION

It is accordingly an objective of the invention to provide a thread brake of the type in which at least one thread guide is used to deflect a thread in order to brake it, but in which the effect of tension spikes is minimized.

In accordance with the principles of a preferred embodiment of the invention, this objective is achieved by providing a transmission between the drive means and the at least one thread guide to transmit the drive motion from the drive means to the thread guide while allowing relative motion between the drive means and the thread guide.

The thread brake of the invention offers the advantage that a rapid drive motion will not directly cause a rapid thread-guide motion, resulting in a reduction in tension spikes during braking. Because the motion of the thread guide depends on the weft tension, when the weft tension is high, the amount of the deflection and consequent braking is less, and the increase in weft tension caused by the braking is in turn limited. Moreover, the thread brake of the invention offers the advantage that even in the event of slackening of the weft tension, the weft still will be kept tensioned.

Furthermore, when the transmission of the preferred embodiment is combined with a controlled drive means, the following additional advantages are obtained: 1.) the tension during weft insertion to be set at a given value and kept there, and 2.) the weft tension to be raised following insertion to be raised, for instance for purposes of cutting, with the raised tension being matchable to a particular kind of weft.

Further features and advantages of the invention will become apparent from the following discussion of the preferred embodiments and by the accompanying drawings.

DETAILED DESCRIPTION OF THE PREFERRED EMBODIMENTS

Figure 1:
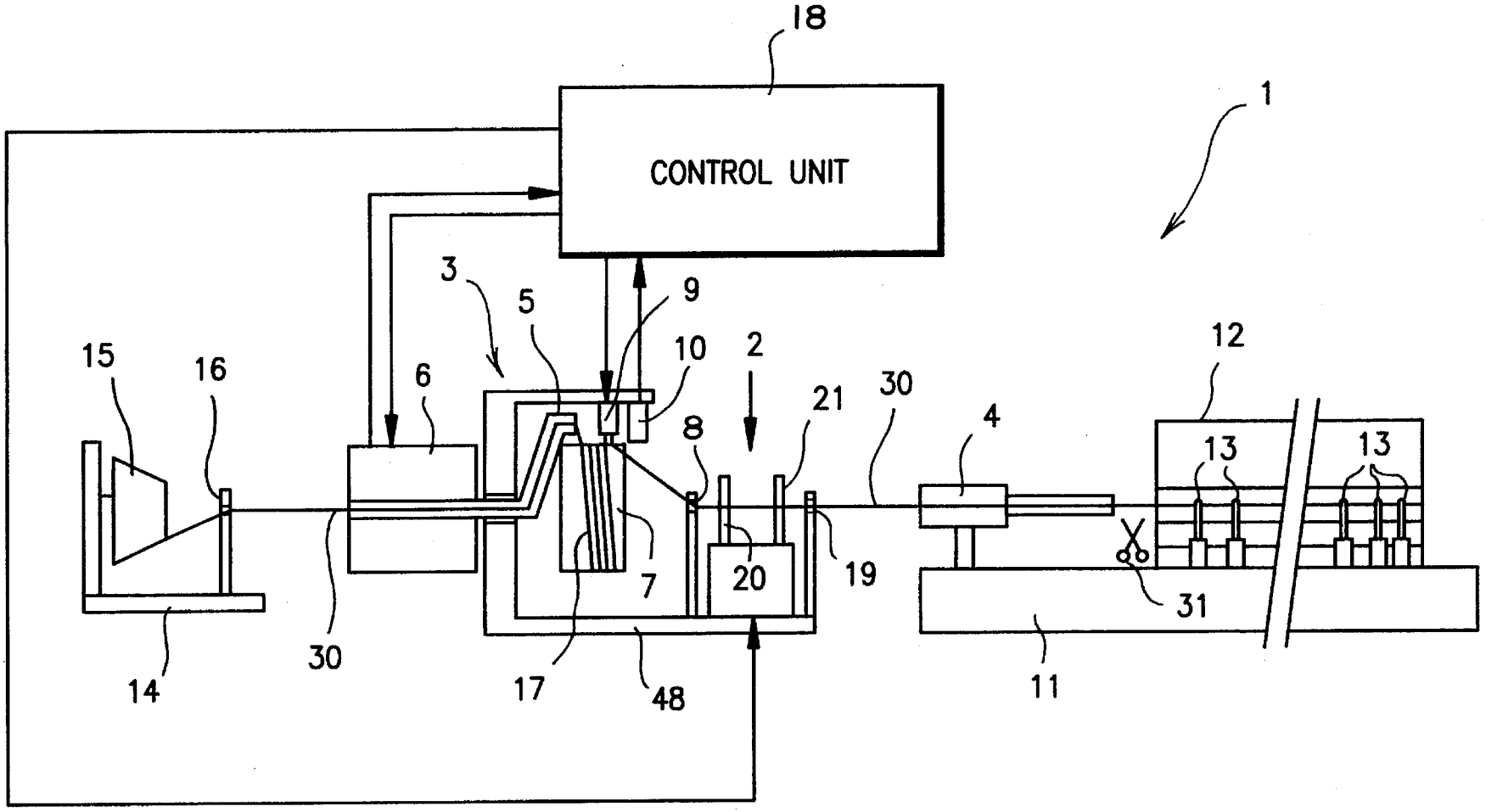
FIG. 1 is a schematic view of an airjet loom fitted the thread brake of the invention.

The airjet loom shown in FIG. I includes a thread brake 2 mounted between a thread storing means 3 for the weft 30 and an insertion means 4 for the weft. The thread storing means 3 is made up of an accumulator having a winding arm 5 driven by a motor 6 for winding the weft 30 into turns 17 on a winding drum 7. The accumulator also includes a magnetically driven pin 9 which can be applied to the winding drum 7 to prevent the turns 17 from being unwound from the drum or from being released. A winding detector 10 is associated with the winding drum 7 and senses the number of turns 17 taken off the winding drum. A stationary thread eye 8 guiding the weft 30 is present downstream of the thread storing means 3 in the direction of the weft insertion means 4.

The insertion means 4 is in the form of a main airjet nozzle mounted on a reed batten 11 of the airjet loom 1 to move with the batten. A contoured reed 12 and accessory airjets 13 are mounted on the reed batten 11 and contribute as is known to insertion of a weft into the shed.

Also shown in FIG. 1 are a bobbin support 14 for a weft bobbin 15 which is mounted upstream of the thread storing means 3 and passes through a thread eye 16 toward the winding arm 5, and a control unit 18 the function of which will be discussed below to the extent that the function is significant for the present invention.

In the embodiment illustrated in FIG. 1, the thread brake 2 is mounted downstream of the thread eye 8. Illustratively, it is affixed to a frame 48 of the thread storing means 3. Beyond the thread brake 2, the frame includes a second thread eye 19. In the illustrated embodiment, the thread brake 2 includes two pin-shaped thread guides 20, 21 arranged to deflect weft 30 between the stationary thread eyes 8, 19. Scissors 31 for cutting weft 30 are mounted on the loom frame between the main airjet nozzle 4 and the reed 12.

Those skilled in the art will appreciate that the thread eyes 8, 19 may alternatively be components of the thread brake 2, and that an auxiliary main airjet nozzle may be affixed on the frame 48 downstream of the thread eye 19.

Figure 2:
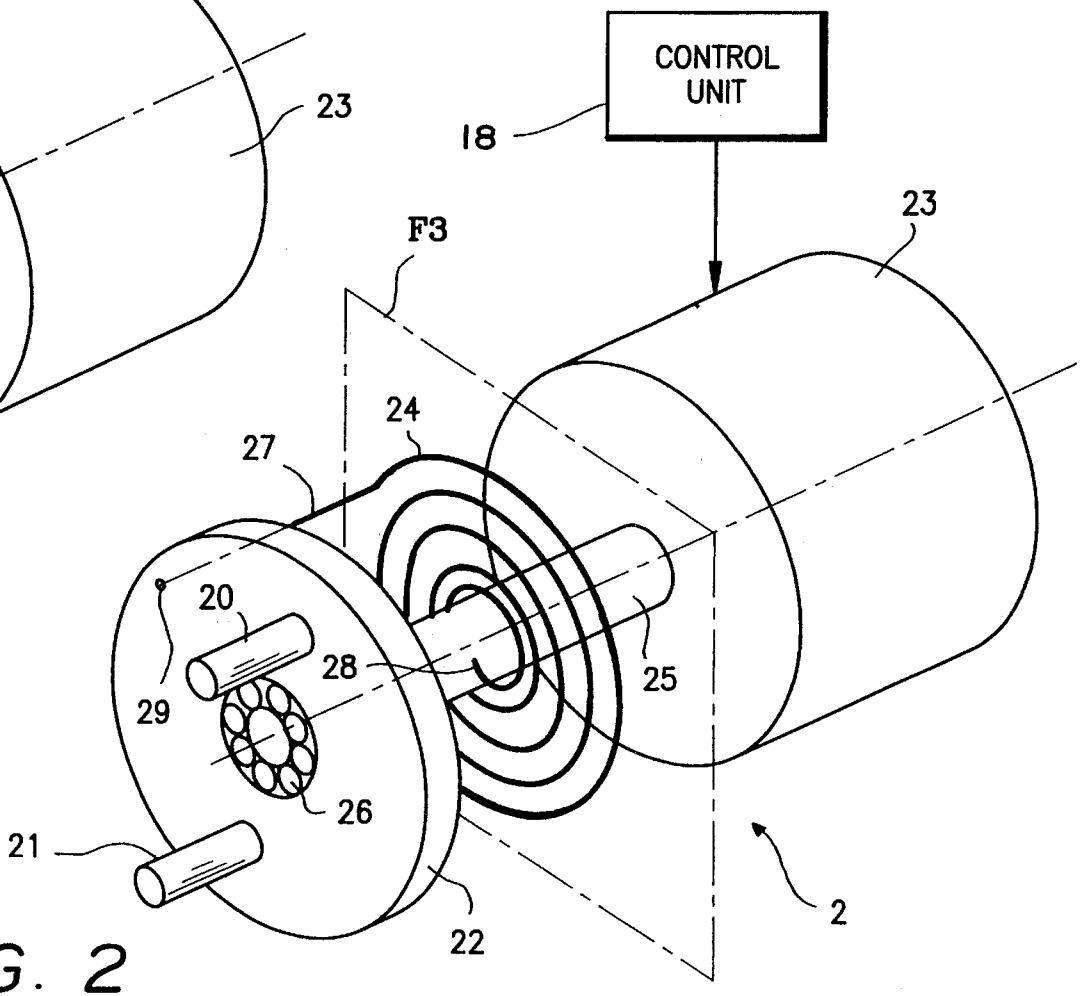
FIG. 2 is an exploded perspective view of the thread brake of a first preferred embodiment of the invention.
Figures 3, 9, 10, 11, 12, 13:
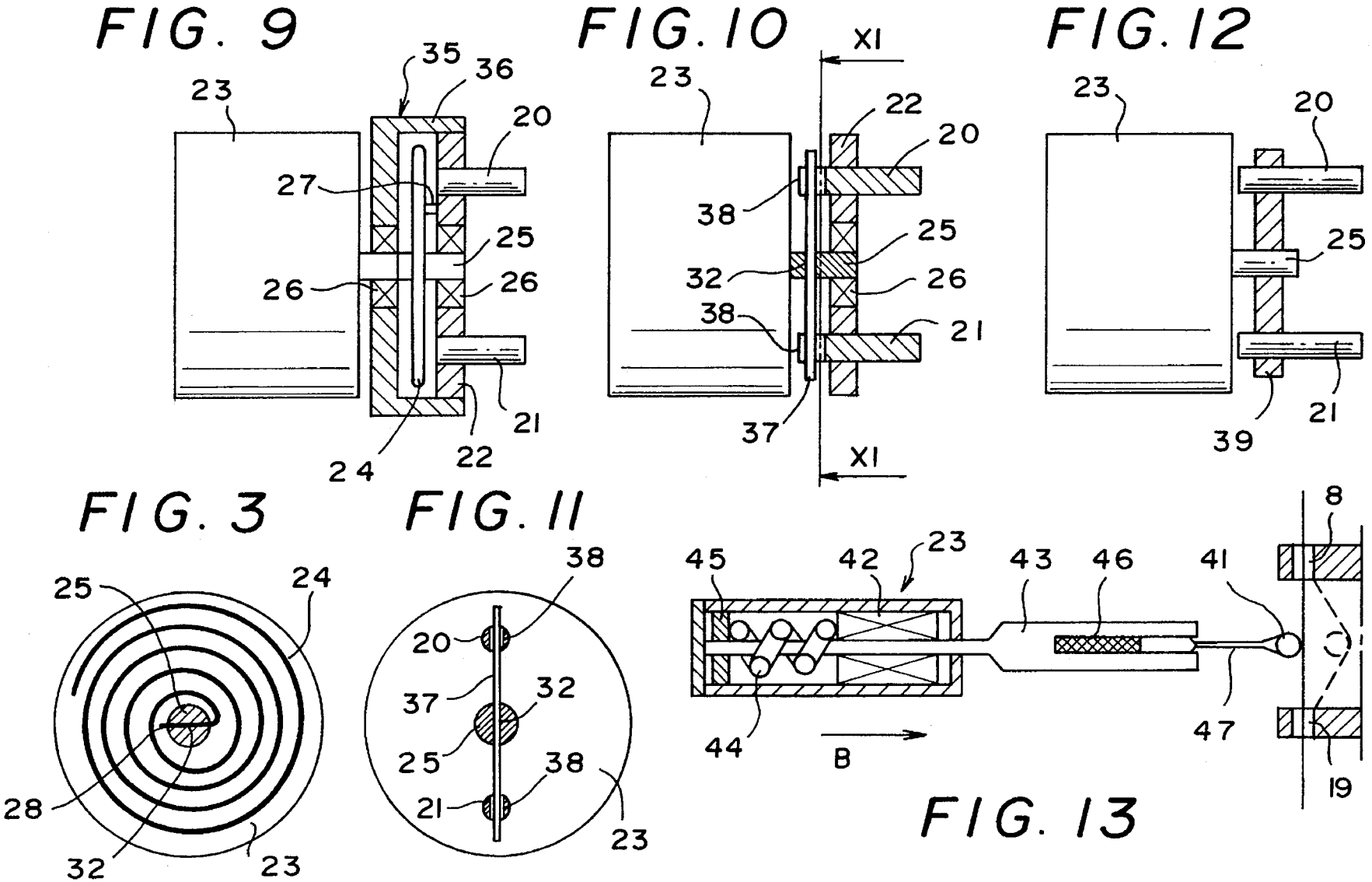
FIG. 3 is an axial view of the cutaway F3 of FIG. 2.
FIG. 9 is a section of a preferred thread brake similar to that of FIG. 3.
FIG. 10 is a section of the thread brake of a further preferred embodiment mode of the invention.
FIG. 11 is a section along line XI—XI of FIG. 10.
FIG. 12 is a section of the thread brake of a simplified preferred embodiment of the invention.
FIG. 13 is a section of a preferred thread brake with a linearly adjustable thread guide.

FIGS. 2 and 3 show a first preferred embodiment of the thread brake 2 generically depicted in FIG. 1. For the sake of clarity, the components are shown in FIG. 2 in exploded manner. The thread brake 2 includes two pin-shaped, diametrically opposite thread guides 20, 21 mounted on a rotatable support disk 22. The position of guide components 20, 21 is predetermined by a drive means controlled by control unit 18. The drive means is made up of a motor 23 and a support disk 22 which rests by means of a roller bearing 26 on a rotatable drive shaft 25 of the motor.

A transmission in the form of a spiral spring 24 is present between the drive shaft 25 and the support disk 22 of the thread guides 20, 21 for transmitting motion from the drive shaft to the support disk. The bent-off outer end 27 of the spiral spring is inserted into a borehole 29 of the support disk 22. The inner end 28 of the spiral spring 24 is held in a borehole 32 of the drive shaft 25 as shown by FIG. 3.

Figure 4:
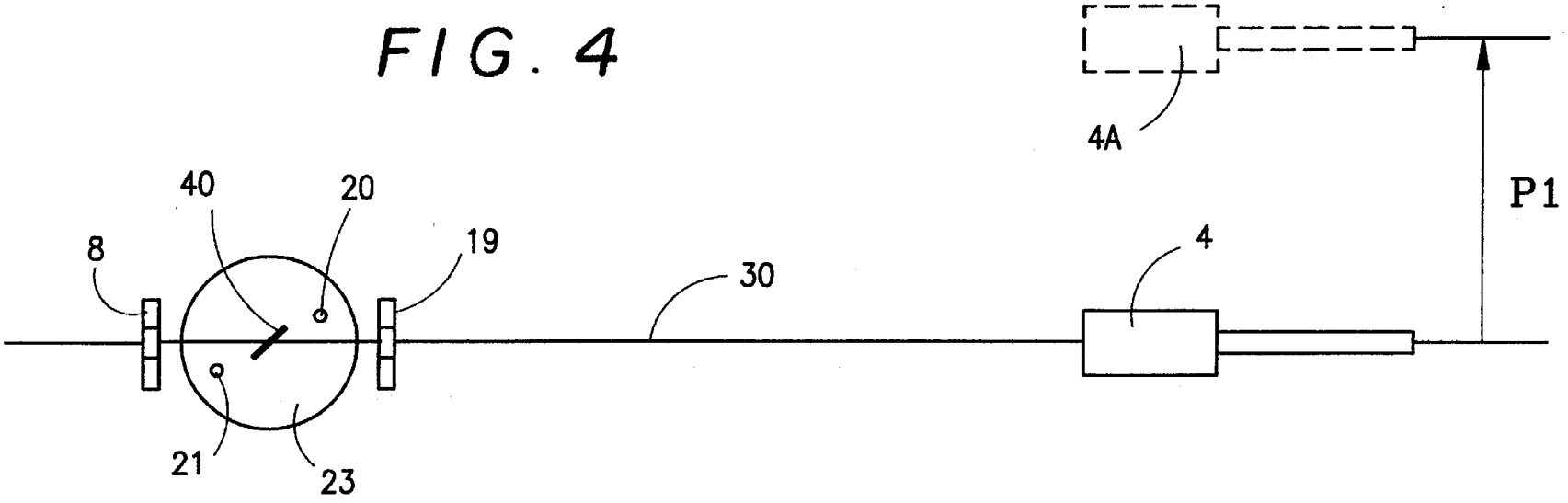
FIGS. 4–6 are schematic views illustrating the progression of a weft in the vicinity of a thread brake for various positions of the thread brake and weft insertion means according to the preferred embodiments of the invention.
Figure 5:
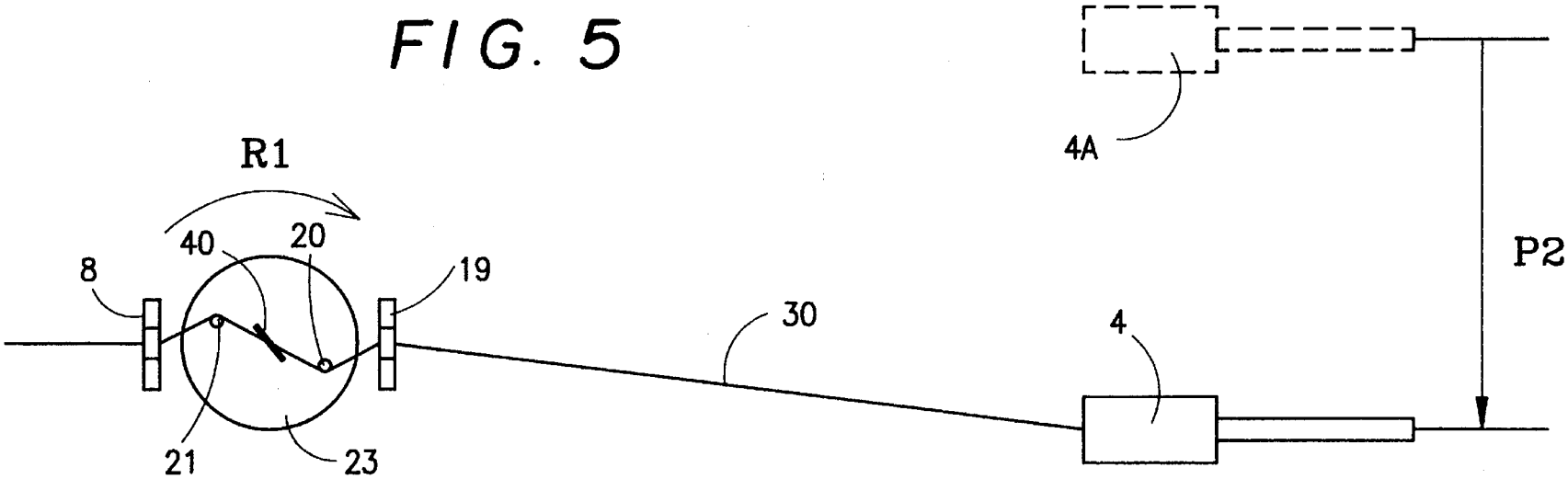
Figure 6:
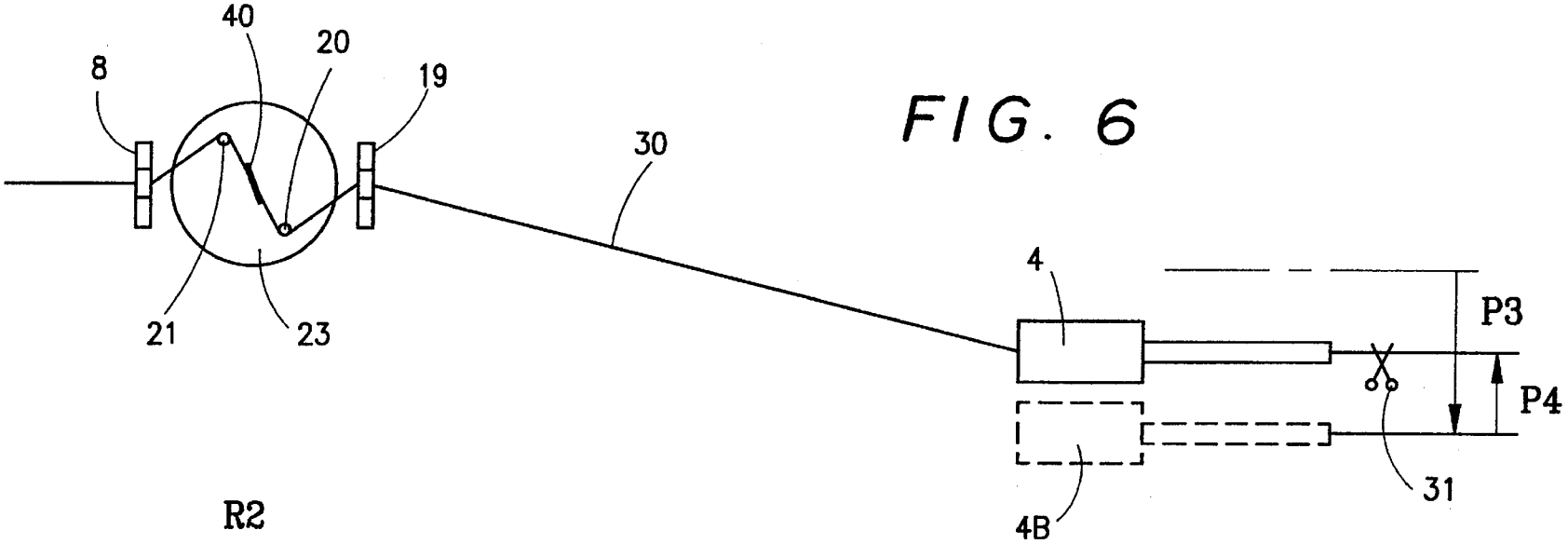

FIGS. 4–6 illustrate the manner in which a weft insertion and the attendant operation of the thread brake 2 is controlled by the control unit 18. At the beginning of the weft insertion, the reed batten 11 together with the main airjet nozzle 4 are in the position shown in FIG. 4, in which the weft 30 runs straight through the thread eyes 8, 19 and the main airjet nozzle 4. This position is advantageous to begin a weft insertion in an airjet loom because in such a configuration the friction of the weft 30 at the thread eyes 8, 19 and at the main airjet nozzle 4 is minimal. In this position, the pin 9 is retracted in such manner from the winding drum 7 that the turns 17 can be drawn off the winding drum, and hence the weft can be inserted by means of the main airjet nozzle 4 into a shed. In this position the thread guides 20, 21 are away from the weft 30. The position of the drive shaft 25 is shown by a thick short line 40 located on the connecting line between the two thread guides 20, 21. Thereafter, the reed batten 11 together with the main airjet nozzle 4 is moved back along the direction of the arrow P1 until the main airjet nozzle 4 arrives at the rear position 4A. Next the reed batten 11 together with the main airjet nozzle 4 moves forward as indicated by the arrow P2 as shown in FIG. 5.

The winding detector 10 senses each turn 17 drawn off the winding drum 7 and emits a corresponding signal to the control unit 18 such that, for example, if the length of an inserted weft 30 corresponds to five turns, then the control unit 18 is able to start the operation of the thread brake 2 after sensing the third removed turn. In the position shown in FIG. 5, the control unit triggers a rotation by the drive motor 23 of the drive shaft 25 in the direction of the arrow R1, causing the shaft to assume the position shown by the short heavy line 40 in FIG. 5, at which time the drive shaft 25 has been rotated by an angle predetermined by the control unit 18. At this instant, however, the thread guides 20, 21 have not yet carried out the same rotation as the drive shaft. Instead, because of the forces exerted by the weft 30 on them, they remain behind. Compensation takes place between the torque exerted by the spring 24 on the support disk 22 and the torque exerted by the weft 30 through the thread guides 20, 21 on the support disk 22.

Figure 7:
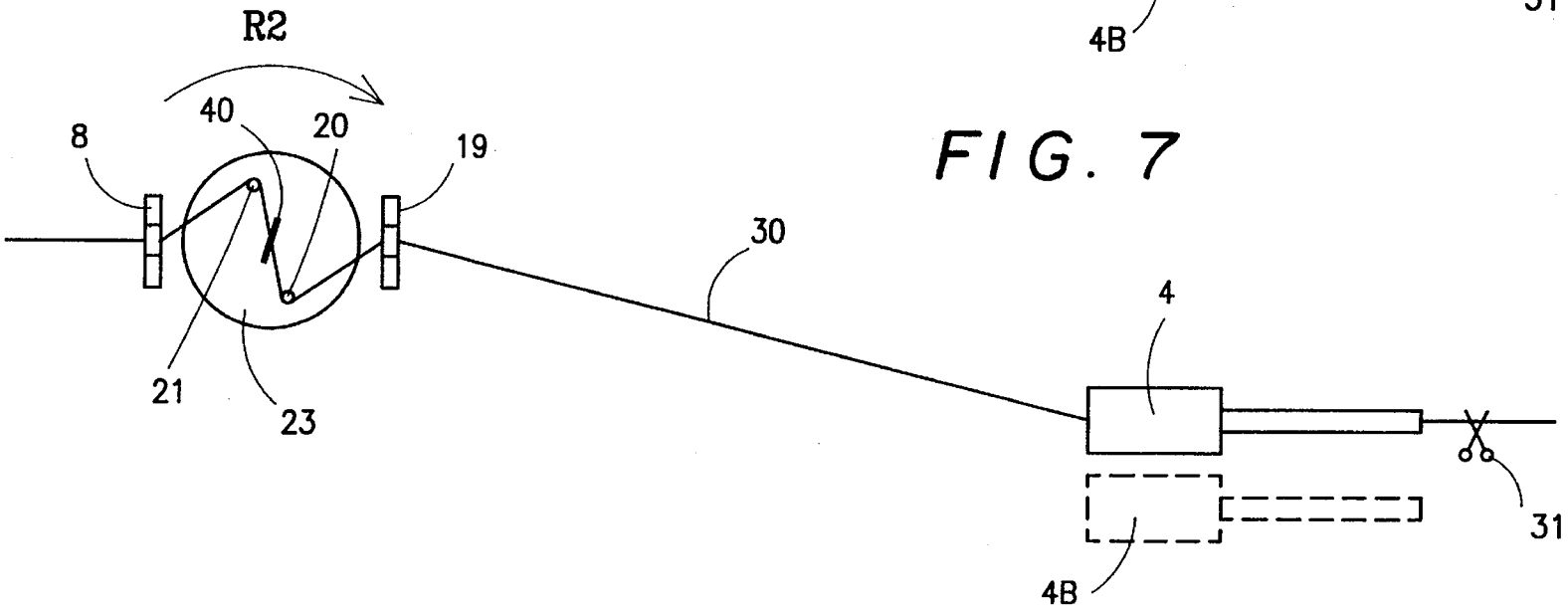
FIG. 7 is a schematic view of the thread progression for a position of the thread brake of the invention which is different from that shown in FIG. 6.

The reed batten 11 then moves, together with the main airjet nozzle 4, further forward in the direction of the arrow P3 until the limit position 4B has been reached. Next, the reed batten 11 together with the main airjet nozzle 4 moves back into the position shown in FIG. 6. Generally, the weft will be cut in this position by the scissors 31. However, because the spacing between the thread eye 19 and the main airjet nozzle 4 decreases when the main airjet nozzle 4 moves back from the limit position into that shown in FIG. 6, the problem arises that the tension in the weft 30 will decrease or even be entirely eliminated at this time. Cutting the weft 30 may be made more difficult thereby. In order to solve this problem, the tension is maintained by moving the thread guides 20, 21 causing the drive shaft to move the thread guides far enough via spring 24 to keep the weft 30 tensioned. To raise the tension in the weft 30 while it is being cut, the control unit 18 of the illustrative embodiment of FIG. 7 thus causes the drive shaft 25 to be rotated further in the direction of the arrow R2, prior to cutting, until the drive shaft 25 reaches the position shown in FIG. 7 (see heavy line 40).

When, after cutting the weft 30, the reed batten 11 is moved back together with the main airjet nozzle 4 from the position shown in FIG. 6 to that shown in FIG. 4, the main airjet nozzles 4 remains loaded with compressed air but at lesser pressure and/or lesser flow. Because the spacing between the guide eye 19 and the main airjet nozzle 4 is less during this process, the weft 30 projects from the position of FIG. 4 with greater length from the main airjet nozzle 4 than in the position of FIG. 6. When weaving with several weft feeds and hence with several main airjet nozzles 4, the additional length of weft 30 may hamper weft insertion by another main airjet nozzle. To prevent such an eventuality, the drive shaft 25 may be rotated further (arrow R2 in FIG. 7) by the control unit 18 in order to retract the weft 30 to within the main airjet nozzle 4.

As will be appreciated by those skilled in the art, the braking by the thread brake 2 may also be varied during weft insertion. Illustratively, drive motor 23 may rotate the drive shaft 25 in a given manner after a predetermined time interval has elapsed during the insertion, for example after the time at which the main airjet nozzle reaches the position shown in FIG. 5, as a result of which the weft 30 is braked ever more strongly. In this process, the angular position of the drive shaft 25 may be controlled as a function of the time at which the winding detector 10 senses turns 17. If, for instance, the third turn is sensed earlier than expected, the thread brake 2 can be switched ON earlier and also at a larger angular rotation of the drive shaft 25.

Similarly, the thread brake 2 may also be controlled at other times during a weft insertion in order to achieve a given thread deflection and hence a desired braking. For example, the braking may be varied not only after a predetermined time interval or middle of the insertion, but also at the beginning of a weft insertion.

Those skilled in the art will should also appreciate that control unit 18 can also serve as the accumulator control. For example, drive motor 6 of the accumulator may be controlled at an average speed by the control unit 18 in such a manner that the winding arm 5 carries out one revolution on average whenever the winding detector 10 senses the removal of one turn 17. Then when sensing the fourth removed turn 17, the pin 9 may illustratively be moved back to the winding drum 7 to prevent further turns from being removed from the winding drum 7.

Figure 8:
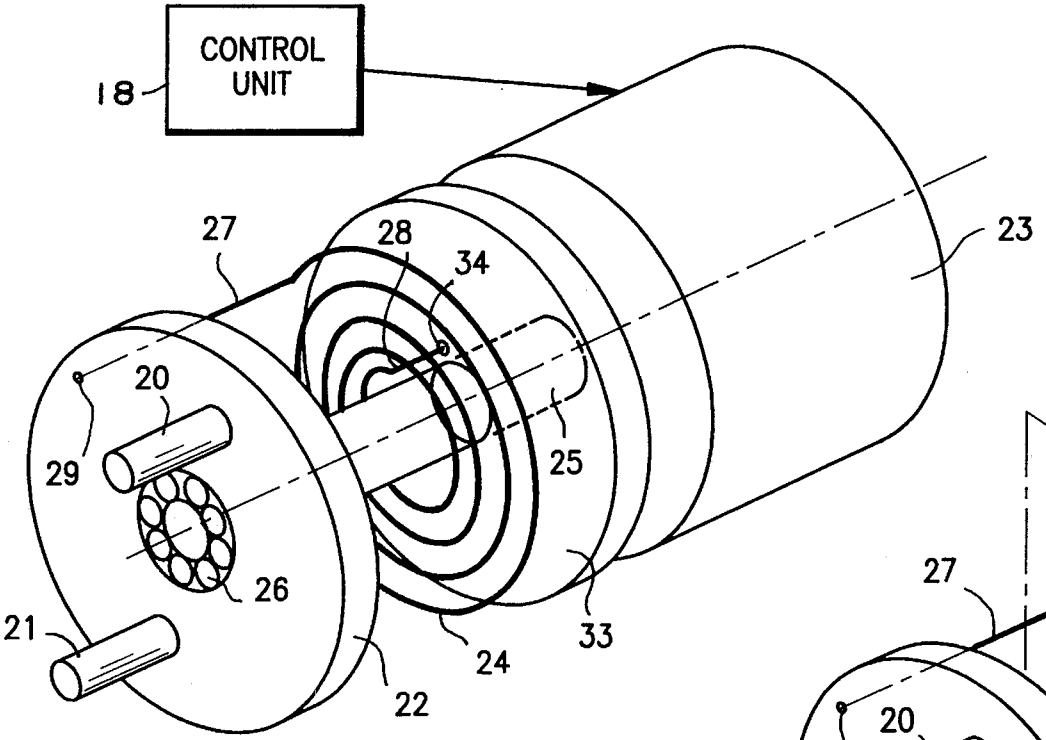
FIG. 8 is a perspective view of the thread brake of a second preferred embodiment of the invention.

In principle, the embodiment of FIG. 8 corresponds to that of FIG. 2. However, spiral spring 24 is indirectly rather than directly attached to the drive shaft 25 via a support disk 33 rigidly affixed to the drive shaft 25, drive shaft 25 including an aperture 34 into which is inserted the inner end 28 of the spiral spring 24.

The embodiment of FIG. 9 also substantially corresponds to that of FIG. 2. Additionally, however, a second pan-shaped support 35 is mounted on the drive shaft and is rotatable relative to the drive shaft. This support is fitted with a collar 36 for receiving the support disk 22, so that the region of the spring 24 is made dust-tight. An outer end 27 of the spring 24 is connected to the support disk 22 and the inner end 28 to the drive shaft 25 in the same manner as shown in FIG. 2.

In the embodiment shown in FIGS. 10 and 11, the thread guides 20, 21 of the support disk 22, which is mounted so as to be rotatable relative to the drive shaft 25 of the drive motor 23, are extended toward the motor 23 and are connected by a leaf spring 37 to the drive shaft 25. The leaf spring 37 is rigidly affixed in a groove 32 to the drive shaft 25 and engages grooves 38 of the thread guides 20, 21. Accordingly, the leaf spring 37 is displaceable inside the grooves 38 and relative motion is possible between the thread guides 20, 21 and the drive shaft 25.

In the embodiment shown in FIG. 12, the thread guides 20, 21 are connected through the intermediary of elastic devices, in particular a leaf spring 39, to the drive shaft 25. A disk support 22 can thus be eliminated. Because of elastic deformation of the leaf spring 39, the thread guides 20, 21 are able to rotate relative to the drive shaft 25.

In the embodiment shown in FIG. 13, on the other hand, a thread guide 41 is provided which is not rotatable, but rather moves linearly between two thread eyes 8, 19 to deflect the weft 30. The drive in this embodiment is an electromagnet 42 associated with an armature 43 displaceable in the direction of the arrow B when the electromagnet 42 is turned ON, i.e., in the direction of thread displacement. A return spring 44 acts on a support 45 rigidly affixed to the drive means 43 which thereby is returned to its initial position opposite the direction of the arrow B. Elastic transmitting devices 46 are present between the drive means 43 and the thread guide 41 and allow relative motion of the thread guide 41 and the drive means 43 opposite the direction of the arrow B. Illustratively, the elastic transmitting devices may be in the form of a spring 46 mounted in a recess of the drive means 43, with a piston rod 47 of the thread guide 41 being guided inside the recess. Alternatively, in variations of this embodiment, rubber bodies, air buffers, or the like may be used as the elastic transmitting means.

In the embodiment shown in FIG. 14, which again uses a rotatable drive shaft arrangement, a magnetic transmission 49 is present between the drive shaft 25 of the motor 23 and the thread guides 20, 21. This magnetic transmission 49 includes two sets of permanent magnets opposite poles of which face each other. One set of permanent magnets 50, 51 is mounted on a support 33 which is rigidly affixed to the drive shaft 25. The second set of permanent magnets 52, 53 is mounted on the support disk 22 which bears the guides 20, 21 and in turn rests by means of a roller bearing 26 on the drive shaft 25. Illustratively, the north poles of the permanent magnets 50, 53 are associated with the south poles of the permanent magnets 51, 52. The supports 22, 33 are close to each other but are shown far apart for clarity in the Figure and because of their proximity, the permanent magnets 50, 52 and 51, 53 will attract each other. In the absence of an external load, the permanent magnets 50, 52 and 51, 53 assure that the support disk 22 and support 33 will always be precisely at the same mutually opposite position. However, the magnetic transmission 49 allows the support disk 22 with the thread guides 20, 21 to rotate relative to the drive shaft 25 when external forces are applied. The magnetic transmission operates in the same manner as described for the elastic transmission 24, 37, 39, 46 of the embodiments of FIGS. 1–13. The magnetic transmission 49 per se contains no movable parts which would have an inertial effect, and thus short reaction times are feasible. The permanent magnets 50, 51 and 52, 53 are magnetically isolated from one another, and those skilled in the art will appreciate that more than two sets of magnets 50, 52 and 51, 53 may be used.

The thread brake 2 of the invention therefore makes it possible to limit the tensions in the weft 30 and thereby to reduce the number of weft ruptures. The relative alignment of the thread brake 2 and the thread eyes 8, 9 to the main airjet nozzle limits tension spikes at the beginning of weft insertion, while tension spikes arising when abruptly starting the thread brake 2 are limited by a relative motion between the drive means and the thread guides 24, 37, 39, 46, 49, and the tension spike produced at the end of weft insertion, namely when the weft 30 is locked in place by the pin 9 returning to the winding drum 7, is reduced because the thread brake 2 has by the time the pin is returned already partly decelerated the weft 30.

Figure 14:
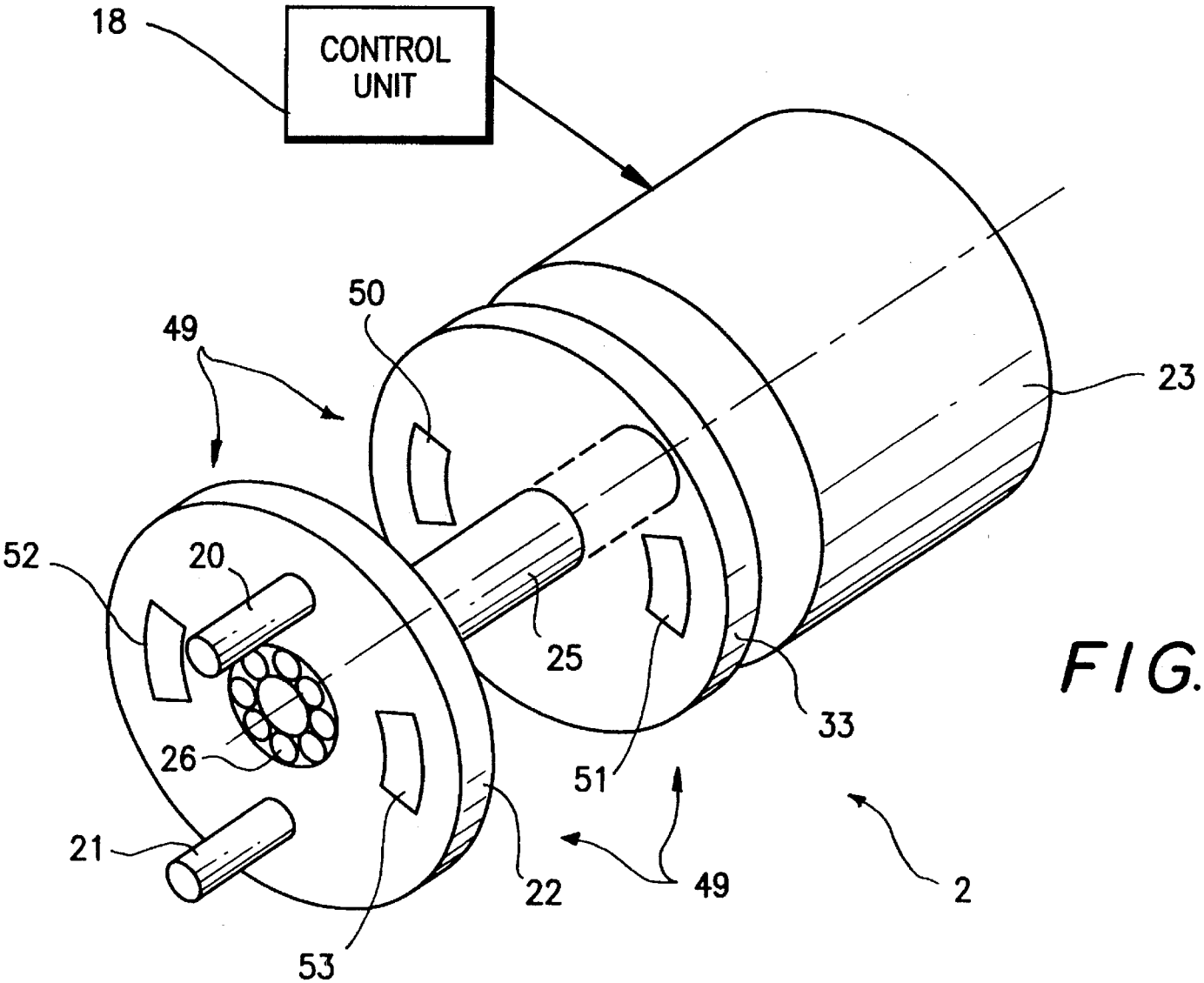
FIG. 14 is an end view of the thread brake of a preferred embodiment of the invention with a magnetic transmission between the drive means and the thread guide.

Furthermore, those skilled in the art will appreciate that the desired tension in the wefts 30 may be adjusted by exchanging the transmissions 24, 37, 39, 46, 49 for others producing different tensions. For example, springs of one kind may be replaced with springs having different spring constants. If a spring similar to the illustrated spiral spring 24 is used, several turns may be joined to each other to thereby alter the spring constant. Moreover, if the permanent magnet transmission of FIG. 14 is used, certain permanent magnets may be replaced with others of different field strengths, and the number of permanent magnets may be varied as noted above.

In yet another variation, more than two thread guides 20, 21 may be provided. For example, four thread guides may be used which would be symmetrically mounted in pairs relative to the drive shaft 25 but at different distances from the shaft. Moreover, additional stationary thread eyes may be mounted between the sets of thread guides.

Having thus described several preferred embodiments of the invention, and several variations and modifications thereof, in sufficient detail to enable those skilled in the art to make and use the invention, it should nevertheless be appreciated that still further variations and modifications of the invention will undoubtedly occur to those skilled in the art, and thus that the invention should not be limited by the above description and drawings, but rather that the invention should be interpreted solely in accordance with the appended claims.

I claim:

1. A thread brake for a loom, said loom including storage means for storing a weft thread to be inserted and insertion means for causing the weft thread stored in the storage means to travel along an insertion path in order to insert the weft thread, said thread brake comprising:

at least one thread guide and drive means for moving the thread guide in order to deflect the weft thread from the insertion path and, as a result of the deflection of the weft thread from the insertion path, thereby brake the weft thread;

supporting means for supporting said thread guide;

a transmission which includes means for transmitting motion of said drive means to said thread guide supporting means while also allowing relative motion between the drive means and the thread guide supporting means, wherein the drive means is a rotary drive device having a drive shaft connected by said transmission to said thread guide so as to join said thread guide supporting means and drive shaft in a relatively displaceable and coaxial manner.

2. A thread brake for a loom, said loom including storage means for storing a weft thread to be inserted and insertion means for inserting the weft thread, and said thread brake comprising:

at least one thread guide and drive means for moving the thread guide in order to deflect the weft thread and therby brake the weft thread;

a transmission which includes means for transmitting motion of said drive means to said thread guide. While also allowing relative motion between the drive means and the thread guide, wherein the thread guide is mounted on a support disk and the support disk is rotatably supported on the drive shaft to which the support disk is connected by said transmission to allow relative rotation between the drive shaft and the support disk.

3. A thread brake for a loom, said loom including storage means for storing a weft thread to be inserted and insertion means for causing the weft thread stored in the storage means to travel along an insertion path in order to insert the weft thread into a shed, said thread brake comprising:

at least one thread guide and drive means for moving the thread guide in order to deflect the weft thread from the insertion path and, as a result of the deflection of the weft thread from the insertion path, thereby brake the weft thread at the end of an inserting operation by which the thread is inserted into the shed;

a transmission which includes means for transmitting motion of said drive means to said thread guide while also allowing relative motion between the drive means and the thread guide, wherein the transmission includes a spring connected between the drive means and the thread guide.

4. A thread brake as claimed in claim 3, wherein the spring is a spiral spring.

5. A thread brake as claimed in claim 3, wherein the drive means is a rotary drive device having a drive shaft connected by said transmission to said thread guide so as to join said thread guide and drive shaft in a relatively displaceable manner.

6. A thread brake for a loom, said loom including storage means for storing a weft thread to be inserted and insertion means for inserting the weft thread, and said thread brake comprising:

at least one thread guide and drive means for moving the thread guide in order to deflect the weft thread and thereby brake the weft thread;

a transmission which includes means for transmitting motion of said drive means to said thread guide while also allowing relative motion between the drive means and the thread guide, wherein the transmission is a magnetic transmission positioned between the drive means and the thread guide.

7. A thread brake for a loom, said loom including storage means for storing a weft thread to be inserted and insertion means for inserting the weft thread, and said thread brake comprising:

at least one thread guide and drive means for moving the thread guide in order to deflect the weft thread and thereby brake the weft thread;

a transmission which includes means for transmitting motion of said drive means to said thread guide while also allowing relative motion between the drive means and the thread guide, wherein the drive means includes a rotatable drive shaft, and further comprising a first support disk rigidly affixed to the drive shaft and a second support disk to which said thread guide is mounted and which is rotatable relative to the drive shaft, said first and second support disks having mounted thereon permanent magnets whose poles are mutually opposed.

8. A thread brake for a loom, said loom including storage means for storing a weft thread to be inserted and insertion means for inserting the weft thread, and said thread brake comprising:

at least one thread guide and drive means for moving the thread guide in order to deflect the weft thread and thereby brake the weft thread;

a transmission which includes means for transmitting motion of said drive means to said thread guide while also allowing relative motion between the drive means and the thread guide, wherein the drive means includes a piston connected to the thread guide and means including an electromagnet having an armature for linearly moving the piston, said armature being connected to the piston by a resilient member which forms said transmission.

9. A thread brake for a loom, said loom including storage means for storing a weft thread to be inserted and insertion means for causing the weft thread stored in the storage means to travel along an insertion path in order to insert the weft thread into a shed, said thread brake comprising:

at least one thread guide and drive means for moving the thread guide in order to deflect the weft thread from the insertion path and, as a result of the deflection of the weft thread from the insertion path, thereby brake the weft thread at the end of an inserting operation by which the weft thread is inserted into the shed;

a transmission which includes means for transmitting motion of said drive means to said thread guide while also allowing relative motion between the drive means and the thread guide, wherein the drive means is a rotary drive device having a drive shaft connected by said transmission to said thread guide so as to join said thread guide and drive shaft in a relatively displaceable manner.

* * * * *